United States Patent [19]

Parkinson et al.

[11] Patent Number: 4,519,632

[45] Date of Patent: May 28, 1985

[54] IDENTIFICATION CARD WITH HEAT REACTIVE COATING

[75] Inventors: Dean B. Parkinson, Redwood City; Orton D. Bergren, Menlo Park, both of Calif.

[73] Assignee: Computer Identification Systems, Inc., Sacramento, Calif.

[21] Appl. No.: 359,961

[22] Filed: Mar. 19, 1982

[51] Int. Cl.[3] ..... B42F 15/00

[52] U.S. Cl. ..... 283/75; 283/72

[58] Field of Search ..... 283/75, 112, 72; 427/410; 428/913

[56] References Cited

U.S. PATENT DOCUMENTS

| | | | |
|---|---|---|---|
| 3,078,182 | 2/1963 | Crone et al. | 40/615 |
| 3,855,033 | 12/1974 | Staats | 283/112 |
| 3,897,964 | 8/1975 | Oka et al. . | |
| 3,930,924 | 1/1976 | Oka et al. | 283/75 |
| 3,950,608 | 4/1976 | Noda et al. . | |
| 4,052,739 | 10/1977 | Wada et al. . | |
| 4,079,673 | 3/1978 | Bernstein | 283/75 |
| 4,251,593 | 2/1981 | Sakamoto et al. | 428/913 |
| 4,273,602 | 6/1981 | Kosaka et al. | 428/913 |
| 4,311,750 | 1/1982 | Kubo et al. | 428/913 |
| 4,311,758 | 1/1982 | Oeda et al. | 428/913 |
| 4,324,420 | 4/1982 | Kosche | 428/913 |
| 4,367,071 | 1/1983 | Mizuno | 428/913 |

*Primary Examiner*—Robert L. Spruill
*Assistant Examiner*—Paul M. Heyrana, Sr.
*Attorney, Agent, or Firm*—Nilsson, Robbins, Dalgarn, Berliner, Carson & Wurst

[57] ABSTRACT

A multi-layered engraved identification card includes a base layer having a first color and a color-changeable, heat sensitive layer initially having a second color which is changeable to a third color contrasting with the first color upon heating to a first temperature for a specified period of time. The color-changeable layer is initially prepared as a solution of a resin, a plasticizer, a heat-sensitive coloring agent for causing the color change, and a solvent in which both the base and the resin of the solution are soluable. Alternatively, the solution may further include a cross-linkable plasticizer with a peroxide to cause the resin of the solution and the plastic of the base to be cross-linked and hence bonded permanently to the base. The engraving may be done after the color changeable layer is formed on the base, or alternatively, the base may be first engraved and the color-changeable solution applied to the non-engraved surface regions or applied to fill the engraved depressions.

15 Claims, 6 Drawing Figures

IDENTIFICATION CARD WITH HEAT REACTIVE COATING

BACKGROUND OF THE INVENTION

The present invention relates to engraved identification cards and in particular to engraved identification cards with a color changeable layer to provide contrast between two or more layers on an engraved card.

Engraved identification cards are known and can be engraved utilizing any one of a number of electronic engraving systems such as those disclosed in Noda, et al., Pat. No. 3,950,608 or Wada, et al., Pat. No. 4,052,739 or any other similar engraving system. Utilizing an electronic engraving system, an image can be engraved in an identification card blank by making a multiplicity of scores through one opaque colored plastic layer of the card blank into a second, different colored opaque plastic layer of the card blank. By varying the depth of the engraved scorings, the width of the regions between the scores will be varied to generate light and dark regions which make up the desired image. A complete description of such identification cards and the method of making them is disclosed in Oka, et al., Pat. No. 3,897,964 and Oka, et al, Pat. No. 3,930,924.

Heretofore, to provide a useful identification card, it was necessary to initially provide a card blank where an opaque base of one color was overlaid with an opaque layer of a contrasting color so that light impinging on the engraved surface of the card would be variably reflected back to the eye of the observer according to the location and amount of top layer removed to form an observable image.

The present invention comprises a novel identification card and method for making the same by disposing a color-changeable solution (1) over the entire surface of a card blank prior to engraving, (2) in the engraved grooves of a pre-engraved card, or (3) on the non-engraved surface regions of a pre-engraved card to form a solid color changeable layer, and thereafter applying heat for a period of time to effect a change in the color of the color-changeable layer to provide contrast between the color-changeable layer and the base layer. Initially the color-changeable layer will preferably be the same color as the base layer. To assure such a color coordination, it is possible to pigment the base layer to match the color of the color-changeable layer. One preferred pigmenting compound used which is heat sensitive to cause a color change is sodium 12-molybdosilicate. That this pigment changes color in the presence of heat is disclosed in Crone, et al., U.S. Pat. No. 3,078,182 which describes the use of sodium 12-molybdosilicate with vinyl copolymers in a pressure-sensitive adhesive formulation which is used for autoclave sterilization indication.

However, the formulation disclosed by Crone, et al., results in a color change only after exposure to heat in excess of about 350° F. which could cause a polyvinyl chloride (PVC) base in accordance with the invention to be damaged. Further, there is no disclosure of diffusion bonding or crosslink bonding to a PVC card or the use of the color changing pigmenting agent to enable "developing" of an engraved card.

SUMMARY OF THE INVENTION

The present invention comprises a multi-layered engraved identification card and a method for making the same wherein the multi-layered identification card includes a base layer of a first color and a color-changeable layer of a second color disposed on and bonded to selected regions of the base layer. Preferably, the color of the color-changeable layer is initially the same as the first color of the base. The color of the color changeable layer is changeable to a third color which contrasts with the first color upon heating of the color-changeable layer to a first temperature for a specified period of time.

In one embodiment, the color-changeable layer is diffusion bonded to the base layer. In another embodiment, the color-changeable layer is bonded to the base by a molecular cross-linking.

The color-changeable layer is initially applied as a solution which may be a dispersion of particulated solids to one surface of the base. The solution includes a resin, a plasticizer for modifying the base material to allow diffusion of the resin thereinto, and a heat-sensitive coloring agent for causing the second color to change to the third color upon being subjected to heating. Finally, the solution includes a solvent in which both the base and the resin are soluble.

In a preferred embodiment of the invention, the coloring agent of the solution is sodium 12-molybdosilicate although other color-changing heteropolymolybdate pigments may be used without departing from the true spirit of the invention.

The solution may further comprise any additional pigmenting or dying agent for altering the color of the color changeable pigment to be a preselected different initial color as to match the color of the base.

A method of making and an identification card having a base and a color-changeable layer includes initially providing a plate or base having a first color. A solution is next prepared comprising a color-changing heteropolymolybdate pigment such as sodium 12-molybdosilicate, a resin which is preferably a catylizing resin whereby the change in color of the heteropolymolybdate pigment is enhanced, a plasticizer for enabling diffusion bonding of the solution to the base, and a solvent in which both the resin and the base are soluble. The prepared solution is next applied as a layer to the base and the solvent allowed to evaporate causing a solid, color-changeable layer to be formed on and diffusion bonded to the base. The resultant blank card is then engraved through the color-changeable layer into the base after which the color-changeable layer is heated to effect a change in color of the color-changeable layer. A contrast between the engraved and non-engraved portions of the engraved identification cards is thereby provided.

In accordance with another embodiment of the invention, the base is initially engraved with the solution being applied to the non-engraved surface regions. In this embodiment, the solution is provided with increased viscosity by the addition of suitable particulate fillers to prevent the solution from flowing into the engraved depressions. After the solvent is evaporated, the card is again subjected to heat to cause a "developing" of the color-sensitive layer to affect the contrast desired between the color-changeable layer and the base.

In still a third embodiment of the invention, the base is initially engraved and the color-changeable solution thinned to have a sufficiently low viscosity to flow into and fill the engraved grooves but leave the non-engraved surface regions of the base exposed. Again, the solvent is allowed to evaporate thereby forming a hard color-changeable layer which changes color when exposed to heat.

BRIEF DESCRIPTION OF THE DRAWINGS

A complete understanding of the present invention and of the above and other advantages thereof may be gained from consideration of the following description of the preferred embodiments taken in conjunction with the accompanying drawings in which.

DETAILED DESCRIPTION

The present invention comprises an engraved identification card and a method for making engraved identification cards whereby a color-changeable layer is disposed on and bonded to one surface of a base material such as a polyvinyl chloride card. An engraved identification card utilizing the base and the color-changeable layer may be made in any one of several different ways. For example, a blank unengraved base may first be coated with a thin layer of the color-changeable material in such a way that the color-changeable material bonds to the surface of the base. The resultant unengraved base with the color-changeable layer is then engraved utilizing available electronic engraving systems such as those disclosed in Noda, et al, Pat. No. 3,950,608 or Wada, et al, Pat. No. 4,052,739.

In another example, an unlayered base material may first be engraved. The color changeable material is then disposed only on the unengraved surface portions of the engraved base. Alternatively, the engraved depressions in the surface of the base can be filled with the color-changeable material leaving the unengraved surface regions exposed.

Figure 1A:
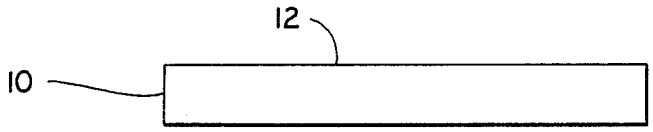
FIGS. 1A, 1B, and 1C are cross-sectional side views illustrating the method of making an engraved card by first applying a color-changeable solution to one surface of a base and thereafter engraving through the color-changeable layer into the base.
Figure 1B:
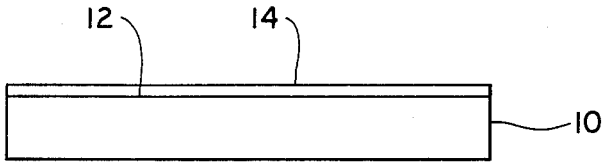
Figure 1C:
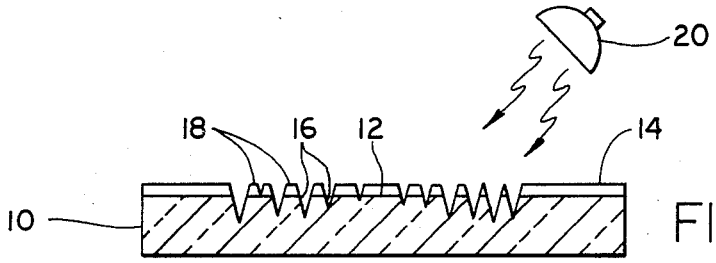

Referring initially to FIGS. 1A, 1B and 1C, one method of making an identification card in accordance with the invention is illustrated. Specifically, base 10 having a top surface 12 is first selected. The base is preferably made of polyvinyl chloride but may also be made of a cellulose acetate, Mylar, or any other material to which a color changeable layer will bond. A solution of color-changeable material to be described hereafter is then prepared and disposed on the top surface 12 where it is cured or otherwise dried to form a color-changeable layer 14 as illustrated in FIG. 1B. In the preferred embodiment, the base 10 is pigmented to be substantially the same color as the color-changeable layer 14 so that the layered card of FIG. 1B appears to be a single-colored nonlayered card. However, the base 10 and the color-changeable layer 14 need not be precisely matched and indeed need not even be the same color in accordance with the broadest aspects of the present invention. The solution applied to form the color-changeable layer 14 is similarly pigmented or dyed. Therefore, the color-changeable layer 14 and the base 10 may be fabricated to have any of a number of different colors.

The resultant identification card with the color-changeable layer 14 illustrated in FIG. 1B is next engraved on a suitable electronic engraving machine to form a plurality of depressions or grooves 16 which extend through the color-changeable layer 14 into the base 10. The grooves or depressions 16 are of variable depth so that the surface regions 18 between grooves are of varying width. The variations in the depth of the grooves 16 and hence in the width of the nonengraved adjacent surface regions 18 define an image.

Figure 2:
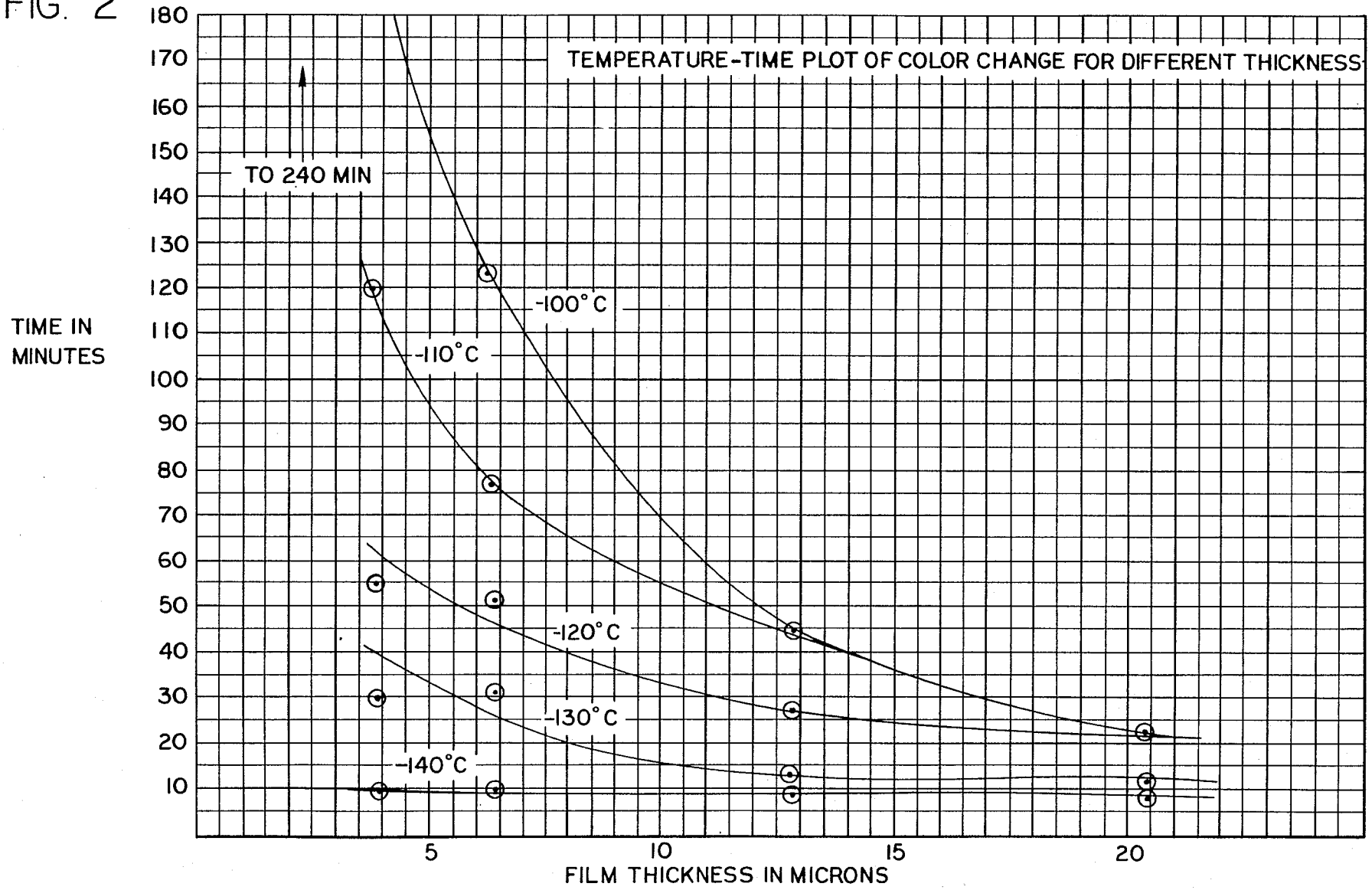
FIG. 2 is a graph illustrating the relationship between the temperature, the duration of heating, and the thickness of the color-changeable layer to effect a change in color.

Because the color-changeable layer 14 and the base 10 are, in the preferred embodiment substantially the same color, the image defined by the combination of the engraved depression 16 and the nonengraved surface regions 18, is not easily observable and indeed can only be observed if at all, because of the variation in reflectivity from the various surfaces defining the depressions and the nonengraved regions 18. Consequently, in accordance with the invention, the color-changeable layer 14 is made of a composition which changes to a color which contrasts with the color of the base layer 10 after being exposed for a period of time to a source of heat 20 or a source of some other form of radiant energy. A particular composition of the color-changeable layer 14 will be described hereafter. Depending upon the specific makeup of the composition and thickness of the layer 14 the change from a non-contrasting to a contrasting color will occur by exposing the color-changeable layer to a temperature of about 88° C. or higher for a period of time sufficient to obtain the color change desired. The length of exposed time decreases as the temperature is increased and as the thickness increases. Additionally, the temperature cannot exceed the temperature at which the base material will melt or otherwise deform or shrink. A graph showing the relationship between the temperature, the exposure time, and the thickness of the color-changeable layer for one specific exemplary composition in accordance with the invention as shown in FIG. 2. Similar graphs can be generated for different color changeable compositions by simple empirical testing.

Figure 3:
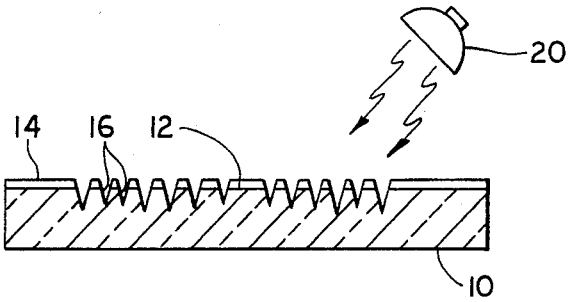
FIG. 3 is a cross-sectional side view of an engraved identification card in accordance with another embodiment where the color-changeable solution is applied after engraving.

Referring to FIG. 3, another embodiment of an identification card in accordance with the invention is illustrated. This card is made by first engraving the top surface 12 of the card blank 10. Thereafter, a solution of the color changeable material 14 is disposed to cover only the remaining non-engraved surface regions 12 between the engraved depressions or grooves 16. One preferred method of applying the solution of color changeable material is to use a steel or other hard surface roller covered with this solution, and thereafter rolling the roller over the card. The color changeable solution is thereby transfered to the surface regions 12. Of course, the solution so applied must not flow so as to fill the engraved depressions 16. In order to achieve a viscosity, which will prevent such flow, fillers such as silica or calcium carbonate can be added to the solution to thereby thicken the solution and increase its viscosity. The degree to which the viscosity will be increased by the addition of fillers also depends on the particle size of the fillers. Thus, the smaller the particle size the greater the increase in viscosity.

In order to thin the solution and thereby lower the viscosity, it is merely necessary to add a solvent. The particular amount of solvent or fillers added will be determined empirically at the time that the solution is prepared.

Referring again to FIG. 3, the color-changeable solution is next allowed to dry by allowing the solvent in the solution to evaporate. The resultant color changeable layer is then exposed to the source of heat 20, whereby the temperature of the color-changeable layer is raised to a predetermined temperature for a predetermined period of time in accordance with empirically obtained test results such as those illustrated in FIG. 2.

Figure 4:
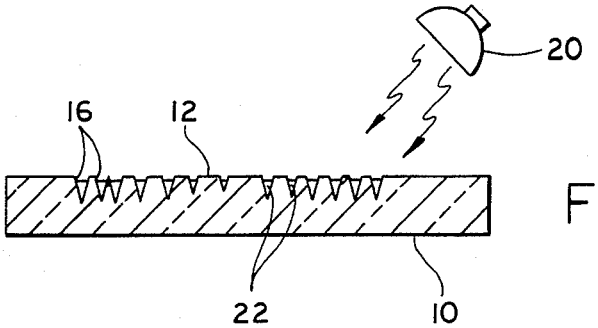
FIG. 4 illustrates another embodiment of the invention whereby the color-changeable solution is applied to fill or partially-fill the engraved depressions while leaving the non-engraved surface regions exposed.

In yet another embodiment of the invention illustrated in FIG. 4, the base 10 is engraved prior to applying the color-changeable solution. However, rather than applying the color-changeable solution on the non-engraved surface regions 12 as described in connection with FIG. 3, the color-changeable solution is applied to fill the engraved grooves 16 while leaving the non-engraved surface regions 12 exposed. This may be accomplished by using a suitable spatula or the like to force the solution into the grooves and yet wipe the surface regions 12 so as to be free of residual amounts of the solution. The resulting solution is then cured or otherwise dried as described above to form a solid, bonded, color-changeable layer 22 in the engraved depressions 16. The engraved card is then exposed to heat from heat source 20 for a period of time and at a temperature selected according to information such as that contained in the chart shown in FIG. 2.

In accordance with the invention, the color-changeable solution is applied to the surface of the base 10 so that the resultant color-changeable layer will have a thickness in the range of about 3 to 15 microns. The solution may be applied by any of a number of different available methods such as silk screen printing, letter press, off-set printing, rotogravure, spraying and masking, or any other available deposition technique.

The bonding of the color-changeable composition to the base may be accomplished by either diffusion bonding or by cross-linking of the molecules of the solution with the molecules of the base.

Diffusion bonding occurs by adding suitable plasticizers to the solution to soften the top surface of the base thereby allowing the solution to diffuse into the top layer of the base. Cross-linking can be obtained by adding a cross-linking plasticizer plus a cross-linking agent such as peroxide to cause the molecules of the color changeable layer to link to the molecues of the base.

EXAMPLE 1

In one particular example, a solution in accordance with the invention was made by combining 13.3 grams of the solvent methylisobutyl ketone, 1.6 grams of the plasticizer Santicizer 160 (TM, Monsanto Industrial Chemicals Company) in particulate form, and 60 grams of the heat sensitive pigmenting agent sodium 12-molybdosilicate in solid particulate form. Because of the large particle sizes of the santizer 160 and the sodium 12-molybdosilicate, the resultant mixture of Santicizer 160 (TM), sodium 12-molybdosilicate and methylisobutyl ketone was placed in a ball mill and ground for 18 to 24 hours. The resultant ground dispersion was then combined with 32 grams of Vinylite (TM) produced by Union Carbide, which is comprised of 86 percent of vinyl chloride, 13 percent of vinyl acetate, and one percent of interpolymerized dibasic acid; and 98 grams of methylisobutyl ketone solvent with the resulting solution (dispersion) hand-stirred to obtain uniform mixing.

Because the ball mill generates substantial heat, and because the combination of the Vinylite to the color-changeable pigment such as the sodium 12-molybdosilicate causes the temperature at which the sodium 12-molybdosilicate changes color to be greatly decreased, it is necessary to add the Vinylite after grinding to prevent a premature change in color during grinding. The temperature at which the sodium 12-molybdosilicate turns black when combined with Vinylite has been found to be as low as 88° C. This is relatively low activation temperature allows the color changeable layer to be applied to vinyl plastic bases such as polyvinyl chloride and the color change later effected without damaging or effecting the base material. Of course, it will be appreciated that if the particle size of the pigmenting agent and the plasticizer is sufficiently small, no ball mill grinding step will be required.

It has also been found that the combination of the sodium 12-molybdosilicate and the Vinylite accelerates the color change so that the time of heating can also be reduced. The reason for this effect is not clearly understood, but is believed to be related to the fact that Vinylite is acid-functional. Therefore, it is likewise believed that other vinyls which are likewise acid-functional will similarly reduce the temperature at which the sodium 12-molybdosilicate will change color and will similarly reduce the time of heating to effect the change in color.

The resultant solution which was pale yellow was then applied to the surface of a white polyvinyl chloride card and the solvent allowed to evaporate to provide a thin layer of color-changeable material on the surface of the polyvinyl chloride card. Subsequently, the card with the color-changeable layer was subjected to heat at about 88 degrees Centigrade for a period of about 2 hours with the result that the color-changeable layer changed from a light green color to a dark black or charcoal color. In accordance with another aspect of the invention, the color changeable layer is bonded very firmly and permanently to the surface of the base. This may be achieved utilizing the solvent and plasticizer such as Santicizer 160 (TM) to effect diffusion bonding whereby the plasticizer modifies the surface of the polyvinyl chloride base so that it is softened to a small depth allowing the solution to diffuse into the surface region of the base. After the solvent evaporates and the solution dries, the resultant color-changeable layer will not only be hard but will be diffused into the top surface of the base thereby forming an extremely firm bond which cannot be broken without destroying the base material.

While the above example has been given with respect to a solution where the solvent and plasticizer are operable both on the copolymer in the solution as well as the copolymer from which the base is made, it will require different plasticizers and different solvents. However, such combinations will be apparent in accordance with the invention once that base material has been selected. Suitable base materials can include polyvinyl butyral or nitryl rubber.

EXAMPLE 2

Another proposed solution would include a cross-linkable plasticizer and peroxide to effect cross-linking between the copolymer in the solution and the copolymer of the base. One such proposed solution would be to combine 100 parts of the vinyl copolymer Vinylite, 30 parts of a cross-linkable plasticizer such as a diacrylic plasticizer, 150 parts of a solvent such as the previously described methylisobutyl ketone, 150 parts of sodium 12-molybdosilicate, and 0.5 parts of benzoyl peroxide so that the weight percent of peroxide to plasticizer is about 1 to 2 percent. Application of this solution will cause molecular cross-linking between the Vinylite and the polyvinyl chloride base material to thereby provide an extremely rigid, virtually unbreakable bond between the color-changeable layer and the base material.

While in the above examples, the color-changeable pigment which has been utilized is sodium 12-molybdosilicate, it will be appreciated that various other color-changeable materials are available and can be utilized. In addition, it is possible to add significant quantities of pigment of different colors to the solutions described in conjunction with either Example 1 or Example 2 to alter the yellow color of the sodium 12-molybdosilicate to obtain any other suitable desired color such as blue, orange, green brown or beige, or red or pink.

In accordance with the invention, there has been described a solution for application to a compatible base material which upon drying will result in a thin layer of color-changeable material bonded to the surface of a base material. The solution in its essential components includes a solvent, polymer, and a heat-sensitive, color-changeable pigment or dye where the polymer utilized is preferably acid-functional and results in an acceleration of the change in color and a lowering of the temperature required to effect the change in color in the pigment or dye utilized.

What is claimed is:

1. A method for making an identification card having a base and a color-changeable layer comprising the steps of:

providing a planar base made of a first compound and having a first color;

preparing a dispersion by intermixing:

a color-changeable heteropolymolbdate pigment;

a resin;

a plasticizer for modifying the first compound to enable bonding of the resin and the pigment thereto; and a non-aqueous solvent in which both the resin and the first compound of the base are soluble;

engraving the base to form a plurality of engraved depressions; .

applying the dispersion to the non-engraved surface regions of the base adjacent to the engraved depression;

allowing the solvent to evaporate to form the color-changeable layer having a second color bonded to the non-engraved surface regions of the base adjacent to the engraved depression; and heating the color-changeable layer to change the second color to a third color to generate an image defined by the contrast in color between the engraved regions having the first color and the color-changeable layer on the non-engraved surface regions of the base.

2. The method of claim 1 wherein the plasticizer is a cross-linkable plasticizer, and the step of preparing the dispersion comprises the further step of intermixing a cross-linking agent in the dispersion to effect molecular cross-linking between the base and the color-changeable first layer.

3. The method of claim 2 wherein the cross-linking agent is peroxide.

4. The method of claim 1 or 2 which further includes the step of pigmenting the base so that the first color is substantially the same as the second color.

5. A method of making an identification card having a base and a color-changeable layer comprising the steps of:

providing a planar base made of a first compound having a first color;

preparing a dispersion by intermixing:

a color-changeable heteropolymolybdate pigment;

a resin;

a plasticizer for modifying the first compound to enable bonding of the resin and the pigment thereinto; and a non-aqueous solvent in which both the resin and the first compound of the base are soluble;

engraving the base to form a plurality of engraved depressions;

applying the dispersion into the engraved depressions in the base;

allowing the solvent to evaporate to form the color-changeable layer having a second color in the engraved depressions in the base;

heating the color-changeable layer to change the second color to a third color to generate an image defined by the contrast in color between the nonengraved surface regions of the base having the first color and the color-changeable layer in the engraved depressions having the third color.

6. The method of claim 5 wherein the plasticizer is a cross-linkable plasticizer, and the step of preparing the dispersion comprises the further step of intermixing a cross-linking agent in the dispersion to effect molecular cross-linking between the base and the color-changeable first layer.

7. The method of claim 6 wherein the cross-linking agent is peroxide.

8. A multilayered identification card comprising:

a base layer having a first color, the base layer having a plurality of depressions of varying depths engraved thereunto to define an engraved image in the base;

a color-changeable layer disposed on and bonded to selected regions of the base layer, the color-changeable layer initially having a second color changeable to a third color contrasting with the first color upon heating to a first temperature for a specified period of time;

the color-changeable layer applied to the base layer as a liquid dispersion including a vinyl copolymer, a cross-linkable plasticizer reactive with the base layer to allow cross-linking of the resin thereto, a cross-linking agent for actuating said cross-linking, a heat-sensitive coloring agent capable of coloring the color-changeable layer in the absence of a co-reactant to change from the second to the third color when subjected to heating, and a non-aqueous solvent in which both the base layer and the vinyl copolymer are soluble; whereby the plasticizer and the cross-linking agent are selected to react with the base layer to effect molecular cross-linking between the color-changeable layer and the base layer for said bonding.

9. The card of claim 8 wherein the heat-sensitive coloring agent is a heteropolymolybdate pigment.

10. The card of claim 9 wherein the heteropolymolybdate pigment is sodium 12-molybdosilicate.

11. A method for making an identification card having a base and a color-changeable layer comprising the steps of:

providing a planar base having a first color;

preparing a dispersion by intermixing:

a color-changeable heteropolymolybdate pigment;

a resin;

a non-aqueous solvent in which both the resin and the planar base are soluble;

a cross-linkable plasticizer reactive with the base for enabling bonding of the resin to the base; and a cross-linking agent;

applying a layer of the dispersion to the base whereby said layer reacts with the base;

allowing the solvent to evaporate to form the color-changeable layer having a second color, said layer being bonded to the base by molecular cross-linking;

engraving through the color-changeable layer into the base; and heating the color of the color-changeable layer to effect a change in color of the color-changeable layer.

12. The method of claim 11 wherein the cross-linking agent is peroxide.

13. The method of claim 11 or 12 comprising the further step of pigmenting the base so that the first color is substantially the same as the second color.

14. A method for making an identification card having a base and a color-changeable layer comprising the steps of:

providing a planar base having a first color;

preparing a dispersion by intermixing:

a color-changeable heteropolymolybdate pigment;

a resin;

a non-aqueous solvent in which both the resin and the planar base are soluble;

a cross-linkable plasticizer reactive with the base for enabling bonding of the resin to the base; and a peroxide cross-linking agent;

applying a layer of the dispersion to the base whereby said layer reacts with the base;

allowing the solvent to evaporate to form the color-changeable layer having a second color, said layer being bonded to the base by molecular cross-linking;

engraving through the color-changeable layer into the base; and heating the color-changeable layer to effect a change in color of the color-changeable layer.

15. A method for making an identification card having a base and a color-changeable layer comprising the steps of:

providing a planar base, said base being pigmented to provide a first color;

preparing a dispersion by intermixing:

a color-changeable heteropolymolybdate pigment;

a resin;

a non-aqueous solvent in which both the resin and the planar base are soluble;

a cross-linkable plasticizer reactive with the base for enabling bonding of the resin to the base; and a cross-linking agent;

applying a layer of the dispersion to the base whereby said layer reacts with the base;

allowing the solvent to evaporate to form the color-changeable layer having a second color substantially the same as the first color, said layer being bonded to the base by molecular cross-linking;

engraving through the color-changeable layer into the base; and heating the color-changeable layer to effect a change in color of the color-changeable layer.

* * * * *

UNITED STATES PATENT AND TRADEMARK OFFICE

CERTIFICATE OF CORRECTION

PATENT NO. : 4,519,632

DATED : May 28, 1985

INVENTOR(S) : Dean B. Parkinson et al

It is certified that error appears in the above-identified patent and that said Letters Patent are hereby corrected as shown below:

Column 9, line 21, "of the" should be deleted.

Column 7, line 39, "heteropolymolbdate" should read --heteropolymolybdate--.

Signed and Sealed this

*Eighth* Day of *October 1985*

[SEAL]

*Attest:*

DONALD J. QUIGG

*Attesting Officer*

*Commissioner of Patents and Trademarks—Designate*